US005861068A

United States Patent [19]

Hasegawa et al.

[11] Patent Number: 5,861,068

[45] Date of Patent: Jan. 19, 1999

[54] METHOD OF USING STAINLESS STEEL HAVING ANTI-MICROBIAL PROPERTY

[75] Inventors: Morihiro Hasegawa; Katsuhisa Miyakusu; Naoto Okubo; Sadayuki Nakamura, all of Sin-Nanyo, Japan

[73] Assignee: Nisshin Steel Co., Ltd., Japan

[21] Appl. No.: 766,788

[22] Filed: Dec. 13, 1996

[30] Foreign Application Priority Data

| | | | |
|---|---|---|---|
| Dec. 15, 1995 | [JP] | Japan | 7-347735 |
| Dec. 26, 1995 | [JP] | Japan | 7-351450 |
| Jan. 12, 1996 | [JP] | Japan | 8-021742 |

[51] Int. Cl.[6] ..... C21D 8/00

[52] U.S. Cl. ..... 148/326; 148/607; 148/608

[58] Field of Search ..... 148/326, 607, 148/608

[56] References Cited

U.S. PATENT DOCUMENTS

| | | | |
|---|---|---|---|
| 3,376,780 | 4/1968 | Tanczyn | 148/326 |
| 5,288,343 | 2/1994 | Yazawa et al. | 148/326 |
| 5,496,421 | 3/1996 | Hashizume et al. | 148/326 |

FOREIGN PATENT DOCUMENTS

| | | |
|---|---|---|
| 610191 | 1/1994 | Japan . |
| 8053738 | 2/1996 | Japan . |
| 8225895 | 9/1996 | Japan . |

*Primary Examiner*—Deborah Yee

*Attorney, Agent, or Firm*—Webb Ziesenheim Bruening Logsdon Orkin & Hanson, P.C.

[57] ABSTRACT

Stainless steel is improved in anti-microbial property by the addition of Cu in an amount of 0.4–5.0 wt. % and the precipitation of Cu-rich phase at the ratio of 0.2 vol. % or more. The Cu-rich phase is precipitated as minute particles uniformly dispersed in the matrix not only at the surface layer but also at the interior by heat treatment such as annealing or aging at 500°–900°. Since the anti-microbial property is derived from the material itself, the underlying stainless steel does not lose the excellent anti-microbial property even after it is polished or mechanically worked. Due to the anti-microbial property, the stainless steel is useful as material in various fields requiring sanitary environments, for example, kitchen goods, electric home appliances, devices or tools at hospitals, parts or interiors for building and grips or poles for electric trains or buses.

20 Claims, 1 Drawing Sheet

METHOD OF USING STAINLESS STEEL HAVING ANTI-MICROBIAL PROPERTY

BACKGROUND OF THE INVENTION

The present invention is related to stainless steel having an improved anti-microbial property, and also related to a method of manufacturing thereof.

Stainless steel represented by SUS 304 has been used as kitchen goods, various devices or tools at hospitals, interior parts for building, grips or poles provided in public transport vehicles, for example, buses or electric trains. However, at the present, time hospital infections caused by *Staphylococcus aureus* has become a serious problem and it has been demanded that stainless steels for hospital use have the necessary anti-microbial property which eliminates the need for periodic disinfection.

An anti-microbial property can be obtained by forming an organic film or an anti-microbial coating layer, as disclosed in Japanese Patent Application Publication No. 6-10191.

However, such an anti-microbial film or layer has the disadvantage that the anti-microbial function disappears in response to the consumption of the film or layer. In addition, the organic film which loses the anti-microbial function also serves as a nutrition source to promote the undesirable propagation of bacilli or germs.

A complex plating layer containing an anti-microbial component exhibits poor adhesiveness to a substrate, resulting in a coated substrate which is inferior in workability. The external appearance and anti-microbial function become worse due to the dissolution, abrasion and defects in the plating layer.

Further, it is well known that metal elements such as Ag or Cu exhibit an effective anti-microbial function. However, Ag is expensive and unsuitable for a part to be used in a corrosive atmosphere. On the other hand, Cu is relatively inexpensive element and effective as an anti-microbial agent. In this regard, it has been investigated to apply an anti-microbial function to a material such as stainless steel by the addition of Cu.

The inventors have researched and examined the effect of Cu on the improvement of anti-microbial properties, and have determined that the anti-microbial function is enhanced by increasing the concentration of Cu in the surface layer of stainless steel, as disclosed in Japanese Patent Applications Laid-Open 6-209121 and 7-55069 corresponding to Publication Nos. 8-53738 and 8-225895, respectively.

SUMMARY OF THE INVENTION

The present invention is directed to the further enhancement of such Cu effect.

The object of the present invention is to apply excellent anti-microbial properties to stainless steel by precipitating a secondary phase mainly composed of Cu (hereinafter referred to as "Cu-rich phase") at a predetermined ratio.

The stainless steel according to the present invention contains 0.4–5.0 wt. % Cu and has a structure in which the Cu-rich phase is dispersed in the matrix at the ratio of 0.2 vol. % or more. The Cu-rich phase is precipitated by heat treatment such as aging or annealing at a temperature specified in relation to the type of stainless steel, i.e. ferritic, austenitic or martensitic type.

The ferritic stainless steel has the composition consisting of 0.1 wt. % or less C, 2 wt. % or less Si, 2 wt. % or less Mn, 10–30 wt. % Cr, 0.4–3 wt. % Cu, optionally 0.02–1 wt. % Nb and/or Ti and the balance being Fe. This stainless steel may further contain at least one of Mo up to 3 wt. %, Al up to 1 wt. %, Zr up to 1 wt. %, V up to 1 wt. %, B up to 0.05 wt. % and rare earth metals (REM) up to 0.05 wt. %.

When such the ferritic stainless steel is aged at 500°–800° C., the Cu-rich phase is precipitated at the ratio of 0.2 vol. % or more. The aging treatment is performed, after the stainless steel is cold rolled and then finally annealed.

The austenitic stainless steel has the composition consisting of 0.1 wt. % or less C, 2 wt. % or less Si, 5 wt. % or less Mn, 10–30 wt. % Cr, 5–15 wt. % Ni, 1.0–5.0 wt. % Cu, optionally 0.02–1 wt. % Nb and/or Ti and the balance being essentially Fe. This stainless steel may further contain one or more of Mo up to 3 wt. %, Al up to 1 wt. %, Zr up to 1 wt. %, V up to 1 wt. %, B up to 0.05 wt. % and rare earth metals (REM) up to 0.05 wt. %.

When such the austenitic stainless steel is heat treated at 500°–900° C. at least one time, the Cu-rich phase is precipitated at the ratio of 0.2 vol. % or more. The heat treatment may be performed on any stage in the process line from hot rolling before the formation of a final product.

The martensitic stainless steel has the composition consisting of 0.8 wt. % or less C, 3 wt. % or less Si, 10–20 wt. % Cr, 0.4–5.0 wt. % Cu and the balance being essentially Fe. This stainless steel may further contain one or two of Mo up to 4 wt. % and V up to 1 wt. %.

In this case, the Cu-rich phase can be precipitated by batch-type annealing, where a hot-rolled steel sheet is heated one hour or longer at 500°–900° C. Thereafter, the steel sheet may be further cold rolled and then finally annealed at 700°–900° C.

DETAILED DESCRIPTION OF THE PREFERRED EMBODIMENTS

Figure 1:
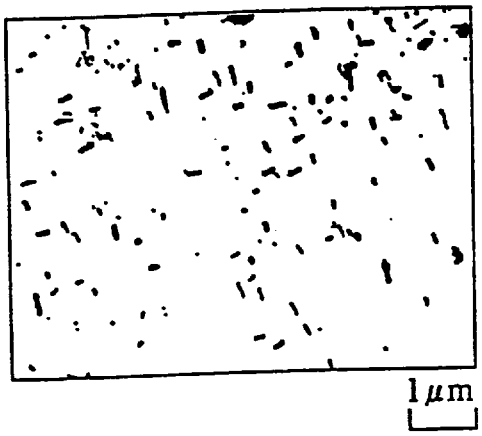
FIG. 1 shows the metallurgical structure of a Cu-containing ferritic stainless steel aged 1 hour at 800° C. observed by a transmission electron microscope.

Stainless steel possesses corrosion resistance in general, since it is coated with a hydroxide layer mainly composed of Cr (so-called "passive film"). The inventors measured the concentration of Cu included in the passive film formed on a ferritic stainless steel containing Cu effective for anti-microbial function, and researched the anti-microbial property by the examination using *Staphylococcus aureus*-containing liquid. It is noted that although the anti-microbial property is improved by the addition of Cu to the steel, the anti-microbial function and its persistency are occasionally insufficient only by dissolving a few % Cu in the steel.

The inventors have advanced the researching on the effect of Cu and found that the precipitation of such Cu-rich phase as shown in FIG. 1 effectively improves the anti-microbial function. When Cu added to the steel is partially precipitated as said Cu-rich phase at the ratio of 0.2 vol. % or more, the anti-microbial function is remarkably enhanced. The Cu-rich phase may have a f.c.c. or h.c.p. structure.

The Cu-rich phase may be precipitated by isothermal heat treatment such as aging at a temperature in the range to facilitate the precipitation of the Cu-rich phase or such slow cooling as holding the steel in the precipitation temperature range for longest possible time. In this regard, the inventors have further studied the effect of heat treatment on the precipitation ratio of the Cu-rich phase. As a result of this research, it has been found that the precipitation of the Cu-rich phase is promoted under different conditions in response to the type of stainless steel, as will be explained hereinafter.

In the case of a ferritic stainless steel, the precipitation of the Cu-rich phase is promoted by aging the steel at a temperature in the range of 500°–800° C. after final annealing. In the case of the austenitic stainless steel, the precipitation of the Cu-rich phase is promoted by aging the steel at a temperature in the range of 500°–900° C. after final annealing. In the case of the martensitic stainless steel, the precipitation of the Cu-rich phase is promoted by batch-type annealing where the Cu-containing martensitic stainless steel is heated at a temperature in the range of 500°–900° C. after final annealing. Even when the martensitic stainless steel is cold rolled and then continuously annealed at 700°–900° C. in succession to said batch-type annealing, the durability of the anti-microbial function is not reduced.

The dispersion of the Cu-rich phase is made more uniform over the whole matrix of the stainless steel by the addition of the other element, for example, Ti or Nb, which easily forms a carbonitride or precipitate. Since such carbonitride or precipitate serves as the precipitation site for the Cu-rich phase, the Cu-rich phase is deposited as minute precipitates, uniformly dispersed in the matrix. Consequently, the stainless steel is further improved in anti-microbial function as well as productivity.

Ferritic Stainless Steel

The alloying elements and those contents in a ferritic stainless steel according to the present invention will be apparent in the following description.

C improves the strength of the ferritic stainless steel. C serves as the alloying element for effectively promoting the uniform dispersion of the Cu-rich phase due to the formation of chromium carbide, too. However, an excessive addition of C in an amount more than 0.1 wt. % reduces productivity and corrosion resistance. Si is an alloying element effective for improving corrosion resistance and strength, but an excessive addition of Si in an amount more than 2 wt. % reduces productivity. Mn is an alloying element effective for improving productivity and stabilizing harmful S as MnS. However, an excessive addition of Mn in an amount more than 2 wt. % reduces corrosion resistance. Cr is an essential alloying element for maintaining the corrosion resistance of the ferritic stainless steel. The corrosion resistance is ensured by a Cr content at 10 wt. % or more. However, the addition of Cr in an amount exceeding 30 wt. % reduces productivity.

Cu is the most important component in the ferritic stainless steel according to the present invention. In order to ensure excellent anti-microbial function, it is necessary to precipitate the Cu-rich phase at a ratio of 0.2 vol. % or more. The precipitation of the Cu-rich phase at said ratio requires the addition of Cu in an amount of 0.4 wt. % or more. However, Cu content should be controlled at 3 wt. % or less, otherwise the excessive addition of Cu causes poor productivity as well as poor corrosion resistance. Although there are no restrictions on the size of Cu-rich phase precipitates, the Cu-rich phase is preferably deposited as minute precipitates uniformly dispersed in the matrix in order to provide an anti-microbial function uniformly to the whole surface of a product.

Nb and Ti are optional alloying elements which may be added to the ferritic stainless steel, and form the precipitates which serve as seeds to uniformly precipitate Cu-rich phase. These functions appear distinctly, when the steel contains Nb and/or Ti in an amount of 0.02 wt. % or more. However, Nb and/or Ti contents shall be restricted at 1 wt. % or less, since the excessive addition of Nb and/or Ti reduces productivity or workability.

Mo is an optional alloying element effective in improving resistance and strength. However, the excessive addition of Mo in an amount more than 3 wt. % reduces the productivity and workability of the steel. Al is an optional alloying element effective in improving corrosion resistance. However, the excessive addition of Al in an amount more than 1 wt. % reduces productivity and workability.

Zr is an alloying element to be added to the steel as occasion demands, and has the function to form carbonitrides effective in the improvement of strength. However, excessive additions of Zr in amounts more than 1 wt. % reduces the productivity or workability of the steel. V is an optional alloying element the same as Zr. However, the excessive addition of V an in amount more than 1 wt. % deteriorates the productivity or workability of the steel. B is an optional alloying element effective in the improvement of hot workability. However, the excessive addition of B in an amount more than 0.05 wt. % causes the deterioration of hot workability. REM's are optional alloying elements having the same function as B. However, the excessive addition of REM in amount more than 0.05 wt. % also reduces hot workability.

Aging Treatment: at 500°–800° C.

When the ferritic stainless steel having the specified composition is aged at 500°–800° C., the Cu-rich phase is effectively precipitated. As the steel is aged at a relatively lower temperature, the ratio of Cu dissolved in the matrix becomes smaller, while the ratio of the Cu-rich phase precipitates becomes larger. However, too low of an aging temperature retards the diffusion of elements in the matrix and causes the reduction of the precipitation ratio. We have researched the effect of the aging treatment on the anti-microbial property under various temperature conditions and reached the conclusion that the temperature range of 500°–800° C. is industrially the most effective range for the precipitation of Cu-rich phase.

Austenitic Stainless Steel

The alloying elements and those contents in an austenitic stainless steel according to the present invention will be apparent from the following description.

C is the alloying element which forms chromium carbide effective as the precipitation site for the Cu-rich phase so as to uniformly disperse minute Cu-rich phase precipitates. However, an excessive addition of C more than 0.1 wt. % causes the reduction of productivity and corrosion resistance. Si is an alloying element effective for improving corrosion resistance as well as the anti-microbial function. However, the excessive addition of Si in amount more than 2 wt. % causes poor productivity. Mn is an alloying element effective for improving productivity and stabilizing harmful S as MnS in the steel. In addition, MnS serves as the precipitation site of the Cu-rich phase so as to minutely precipitate the Cu-rich phase. However, an excessive addition of Mn in amounts more than 5 wt. % reduces corrosion resistance. Cr is an essential alloying element for ensuring the corrosion resistance of the austenitic stainless steel. Cr content in amount of 10 wt. % or more is necessary in order to obtain sufficient corrosion resistance. However, the excessive addition of Cr in an amount more than 30 wt. % reduces productivity and workability. Ni is an alloying element necessary for the stabilization of austenitic phase. However, an excessive addition of Ni increases the consumption of expensive Ni and thus raises the cost of the steel. In this regard, Ni content is controlled 15 wt. % or less.

Cu is the most important component in this austenitic stainless steel according to the present invention. In order to obtain sufficient anti-microbial function, the Cu-rich phase is precipitated at a ratio of 0.2 vol. % or more. Said precipitation in the austenitic stainless steel necessitates the addition of Cu in an amount of 1.0 wt. % or more. However, an excessive addition of Cu in an amount more than 5.0 wt. % reduces productivity, workability and corrosion resistance. There are no restriction on the size of Cu-rich phase precipitates. However, the proper dispersion and distribution of the precipitated Cu-rich phase in both of the surface layer and the interior is preferable so as to exhibit anti-microbial function uniformly over the whole surface of a steel product and to keep a sufficient underlying anti-microbial function so as to provide anti-microbial function even when the surface layer is polished or otherwise removed.

Nb forms carbide, nitride and/or carbonitride dispersed in the matrix. These precipitates effectively promote the minute and uniform dispersion of the Cu-rich phase in the matrix, since the Cu-rich phase is likely to precipitate around these initial precipitates. However, the excessive addition of Nb reduces productivity and workability. Therefore, Nb content is preferably controlled in the range of 0.02–1 wt. %, when Nb is added to the steel. Ti has the same function as Nb. However, since the addition of Ti in excessive amounts reduces productivity or workability, scratches are easily formed on the surface of an obtained product. In this regard, Ti content is preferably controlled in the range of 0.02–1 wt. %, when Ti is added to the steel.

Mo is an optional alloying element effective for improving corrosion resistance. Mo forms the intermetallic compounds such as $Fe_2Mo$ which also serve as the precipitation site of the Cu-rich phase. Mo as well as the Mo-containing compounds are also effective in the improvement of anti-microbial function. However, the addition of Mo in an excessive amount more than 3 wt. % reduces productivity and workability. Al is an otional alloying element effective for improving corrosion resistance and for minutely precipitating the Cu-rich phase. However, the addition of Al in an excessive amount more than 1 wt. % reduces productivity or workability. In this regard, the Al content is controlled to 1 wt. % or less, when Al is added to the steel. Zr is the optional alloying element which forms carbonitrides effective for the minute precipitation of the Cu-rich phase. However, the addition of Zr in an excessive amount more than 1 wt. % reduces productivity or workability. V is the optional alloying element which forms carbonitrides as the same as Zr, so as to facilitate the minute precipitation of the Cu-rich phase. However, the excessive addition of V in an amount more than 1 wt. % reduces productivity or workability. B is an optional alloying element effective for improving hot workability and forming precipitates uniformly dispersed in the matrix. However, the addition of B in an excessive amount more than 0.05 wt. % reduces hot workability. REM's are optional alloying elements. When REM's in a proper amount are added to the steel, the steel is improved in hot workability. In addition, REM's form precipitates, effective for the minute precipitation of the Cu-rich phase, uniformly dispersed in the matrix. However, the addition of REM's in excessive amounts more than 0.05 wt. % reduces hot workability.

When the austenitic stainless steel having the specified composition is heat treated at 500°–900° C. , the Cu-rich phase is effectively precipitated in the matrix at the ratio of 0.2 vol. % or more. As the heating temperature becomes relatively lower, the ratio of Cu dissolved in the matrix is reduced, while the precipitation ratio of the Cu-rich phase is increased. However, heating at too low of a temperature retards the diffusion of elements in the steel and reduces the precipitation ratio. We have studied the effect of aging treatment on the anti-microbial property under various temperature conditions, and reached the conclusion that one hour or longer aging treatment at a temperature in the range of 500°–900° C. is industrially advantageous. The aging treatment may be applied to the steel at any stage in the process line from hot rolling until the formation of a final product.

Martensitic Stainless Steel

The alloying elements and those contents in a martensitic stainless steel according to the present invention will be apparent in the following description.

C is an alloying element effective for improving the strength of a quench-tempered martensitic stainless steel. C forms chromium carbide which serves as the precipitation site of a Cu-rich phase so as to uniformly disperse minute Cu-rich precipitates in the matrix. However, the excessive addition of C in amount more than 0.8 wt. % reduces corrosion resistance or ductility. Si is an alloying element effective as a deoxidizing agent and functions to improve temper softening resistance and to improve the anti-microbial property. These effects are increased up to 3.0 wt. % Si, but not enhanced any more even when Si in amount more than 3 wt. % is added to the steel. Cr is an alloying element necessary for the corrosion resistance of the martensitic stainless steel. Cr content should be controlled to 10 wt. % or more in order to ensure corrosion resistance necessary for use. However, the excessive addition of Cr in an amount more than 20 wt. % reduces the hardness of the quenched steel and causes poor workability and ductility due to the formation of coarse eutectic carbide.

Cu is the most important component in the martensitic stainless steel according to the present invention. In order to obtain sufficient anti-microbial function, the Cu-rich phase should be precipitated at the ratio of 0.2 vol. % or more. Said precipitation in the martensitic stainless steel necessitates the addition of Cu in amount of 0.4 wt. % or more. However, the excessive addition of Cu in an amount more than 5.0 wt. % reduces productivity, workability and corrosion resistance.

There are no restrictions on the size of Cu-rich phase precipitates. However, the proper dispersion and distribution of the Cu-rich phase in both of the surface layer and the interior is preferable to exhibit anti-microbial function uniformly over the whole surface of a steel product and to maintain sufficient anti-microbial function even when the surface layer is polished.

Mo is an optional alloying element effective for improving corrosion resistance. Mo forms the intermetallic compounds such as $Fe_2Mo$ which serve as the precipitation site to facilitate the minute dispersion of the Cu-rich phase. In addition, Mo and Mo-containing compounds themselves effectively improve anti-microbial property. However, the excessive addition of Mo in an amount more than 4 wt. % reduces productivity and workability. An optional alloying element V forms the carbide which serves as the precipitation site to facilitate the minute precipitation of Cu-rich phase. The formation of cabide is effective in the improvement of abrasion resistance and temper softening resistance. However, the excessive addition of V in an amount more than 1 wt. % reduces productivity and workability.

The martensitic stainless steel may further contain one or more of Nb up to 0.5 wt. %, Ti up to 1.0 wt. % and Ta or Zr up to 0.3 wt. % to contribute to the formation of fine crystal grains effective in providing low-temperature toughness. Al up to 1.0 wt. % and W up to 2.0 wt. % may be optionally added to improve temper-softening resistance, as well as Ni up to 2.0 wt. % for the purpose of improving strength and toughness. Finally B up to 0.01 wt. % may be added to improve hot workability.

When the martensitic stainless steel having the specificed composition is subjected to batch-type annealing, the Cu-rich phase is precipitated in the matrix. The ratio of Cu dissolved in the matrix becomes smaller at lower annealing temperatures. However, a too low of a temperature, the diffusion of elements in the steel is retarded, so that the precipitation ratio is reduced. The inventors have studied the effect of annealing conditions on the anti-microbial function and have reached the conclusion that an annealing temperature of 500°–900° C. is industrially the most effective in achieving the anti-microbial property. The annealing shall be continued at least one hour.

The Cu-rich phase precipitated in the matrix during annealing the hot rolled steel sheet is increased but not reduced in amount, when the steel sheet is subjected to final annealing at 700°–900° C. Therefore, the steel sheet may be intermediately annealed at a temperature in the range of 700°–900° C., although the process according to the present invention basically comprises the steps of one cold rolling step and one annealing step.

EXAMPLES

Example 1

Ferritic stainless steels each having the composition shown in Tables 1 and 2 were melted in a 30 kg-vacuum melting furnace, forged, hot rolled and then annealed. The obtained hot rolled sheet was repeatedly subjected to cold rolling and annealing, and finally formed into an annealed cold rolled sheet of 0.5–1.0 mm in thickness. A part of the steel sheets obtained in this way were further subjected to 1 hr. aging treatment.

Test pieces prepared from these steel sheets were observed under a transmission electron microscope (TEM). For instance, the uniform and minute dispersion of the Cu-rich phase was detected in a thin film sample obtained from the test piece of steel K4 aged 1 hr. at 800° C., as shown in FIG. 1, and excellent anti-microbial function was noted as far as the steel had the structure wherein the Cu-rich phase was uniformly and minutely dispersed. The precipitation of the Cu-rich phase was quantitatively measured by the microscopic observation.

The anti-microbial examination was done as follows:

(1) Test organisms

*Escherichia coli* IF03301

*Staphylococcus aureus* IF012732

(2) Preparation of cell suspensions

Each test organism was grown on Nutrient Broth (offered by Eiken Chemical Co., Ltd.) for 16–20 hrs. at 35° C. with shaking. After incubation, each culture was diluted 20,000 fold with a phosphate buffer, to use as the cell suspension for the test.

(3) Experimental procedure

A 1-ml portion of each cell suspension was dropped on the surface of each sample (5×5cm), which was incubated at 25° C. The viable cells of each sample were copunted after 24 hrs. of incubation. A 1-ml portion of each cell suspension dropped in a petridish was used as a control sample, which was tested in the same way.

(4) Viable cell counts

The sample and the control sample were each washed out with 9-ml of SCDLP (Soybean-Casein Digest Broth with Lecithin & Polysorbate) medium (offered by Nihon Pharmaceutical Co., Ltd.). Viable cells in the washing were counted by the pour plate method (incubated at 35° C. for 48 hrs.) with Plate Count Agar (offered by Eiken Chemical Co., Ltd.). The viable cells per sample or control sample were calculated from the count of each washing.

The examination results were evaluated and classified as follows: The mark ⊙ represents the case where any living microbes were not detected, the mark ○ represents the case where microbes were sterilized at the ratio of 95% or more in comparison with the reference value, the mark Δ represents the case where microbes were sterilized at the ratio of 60–90%, and the mark x represents the case where microbes were sterilized at the ratio not more than 60%.

The evaluation together with the precipitation of Cu-rich phase is shown in Tables 1 and 2.

TABLE 1

THE EFFECT OF THE COMPOSITION OF FERRITIC STAINLESS STEEL AND AGING TREATMENT ON PRECIPITATION RATIO OF Cu-RICH PHASE AND ANTI-MICROBIAL PROPERTY (THE PRESENT INVENTION)

| STEEL | ALLOYING COMPONENTS (wt. %) | | | | | | | | | | AGING TEMP. | Cu-RICH PHASE | ANTI-MICROBIAL |
|---|---|---|---|---|---|---|---|---|---|---|---|---|---|
| KIND | C | Si | Mn | Ni | Cr | N | Cu | Nb | Ti | OTHERS | (°C.) | (vol. %) | PROPERTY |
| K 1 | 0.01 | 0.31 | 0.20 | 0.10 | 16.8 | 0.01 | 0.48 | — | — | — | 600 | 0.25 | ⊙ |
| K 2 | 0.01 | 0.31 | 0.20 | 0.10 | 16.9 | 0.01 | 1.00 | 0.37 | — | — | 700 | 0.46 | ⊙ |
| K 3 | 0.01 | 0.31 | 0.20 | 0.10 | 16.8 | 0.01 | 1.50 | 0.37 | — | — | 500 | 0.78 | ⊙ |
| K 4 | 0.01 | 0.31 | 0.20 | 0.10 | 16.7 | 0.01 | 2.02 | 0.87 | — | — | 800 | 2.02 | ⊙ |
| K 5 | 0.01 | 1.86 | 0.20 | 0.10 | 16.6 | 0.01 | 0.51 | 0.37 | — | — | 700 | 0.31 | ⊙ |
| K 6 | 0.07 | 1.86 | 0.33 | 0.22 | 16.2 | 0.02 | 1.00 | — | 0.05 | B: 0.02 | 700 | 0.30 | ⊙ |
| K 7 | 0.06 | 1.02 | 0.30 | 0.21 | 16.1 | 0.01 | 1.55 | — | 0.45 | B: 0.01 | 700 | 0.55 | ⊙ |
| K 8 | 0.01 | 0.33 | 1.77 | 0.11 | 23.5 | 0.01 | 2.77 | — | 0.82 | — | 800 | 1.72 | ⊙ |
| K 9 | 0.01 | 0.20 | 0.21 | 0.10 | 11.0 | 0.01 | 1.01 | — | — | Mo: 2.69 | 700 | 0.22 | ○ |
| K10 | 0.01 | 0.20 | 0.20 | 0.09 | 13.1 | 0.01 | 1.00 | — | — | Al: 0.81 | 700 | 0.28 | ○ |
| K11 | 0.01 | 0.29 | 0.22 | 0.10 | 13.0 | 0.01 | 1.51 | — | — | V: 0.90 | 600 | 0.81 | ⊙ |
| K12 | 0.01 | 0.30 | 0.20 | 0.10 | 12.8 | 0.02 | 1.02 | — | — | Zr: 0.79 | 600 | 0.44 | ⊙ |
| K13 | 0.01 | 0.31 | 0.21 | 0.10 | 28.1 | 0.01 | 1.48 | — | — | REM: 0.02 | 700 | 0.29 | ○ |

TABLE 2

THE EFFECT OF THE COMPOSITION OF FERRITIC STAINLESS STEEL AND AGING TREATMENT ON PRECIPITATION RATIO OF Cu-RICH PHASE AND ANTI-MICROBIAL PROPERTY (COMPARATIVE EXAMPLES)

| STEEL | ALLOYING COMPONENTS (wt. %) | | | | | | | | | | AGING TEMP. | Cu-RICH PHASE | ANTI-MICROBIAL |
|---|---|---|---|---|---|---|---|---|---|---|---|---|---|
| KIND | C | Si | Mn | Ni | Cr | N | Cu | Nb | Ti | OTHERS | (°C.) | (vol. %) | PROPERTY |
| K14 | 0.01 | 0.27 | 0.22 | 0.11 | 11.2 | 0.01 | 0.01 | — | — | — | no | 0.02 | X |
| K15 | 0.01 | 0.30 | 0.20 | 0.11 | 16.6 | 0.01 | 0.01 | 0.37 | — | — | no | 0.01 | X |
| K16 | 0.01 | 0.31 | 0.20 | 0.10 | 16.5 | 0.01 | 0.27 | 0.35 | — | — | no | 0.07 | Δ |
| K 1 | 0.01 | 0.31 | 0.20 | 0.10 | 16.8 | 0.01 | 0.48 | — | — | — | no | 0.05 | Δ |
| K 2 | 0.01 | 0.31 | 0.20 | 0.10 | 16.9 | 0.01 | 1.00 | 0.37 | — | — | no | 0.08 | Δ |
| K 3 | 0.01 | 0.31 | 0.20 | 0.10 | 16.8 | 0.01 | 1.50 | 0.37 | — | — | 400 | 0.07 | Δ |
| K 4 | 0.01 | 0.31 | 0.20 | 0.10 | 16.7 | 0.01 | 2.02 | 0.87 | — | — | 900 | 0.18 | Δ |
| K17 | 0.06 | 0.46 | 0.30 | 0.21 | 16.3 | 0.01 | 0.01 | — | 0.01 | B: 0.01 | 500 | 0.07 | X |
| K18 | 0.06 | 0.42 | 0.31 | 0.15 | 16.5 | 0.01 | 0.25 | — | 0.01 | B: 0.01 | 600 | 0.06 | X |

It is noted from Table 1 that the ferritic stainless steel containing 0.4 wt. % or more Cu and having the structure that the Cu-rich phase was precipitated in the matrix at the ratio of 0.2 vol. % or more exhibited excellent anti-microbial function.

On the other hand, the test pieces K14 to K16 in Table 2 containing Cu not more than 0.4 wt. % had the Cu-rich phase precipitated at a smaller ratio and showed poor anti-microbial function. As for the test pieces K1 and K2 containing Cu in approximately same amount but not subjected to the aging treatment for the precipitation of the Cu-rich phase, it is noted that anti-microbial property was slightly improved, but sufficient anti-microbial property was not obtained. Even when the steel contains Cu in amount of 0.4 wt. % or more, anti-microbial function was changed in response to the temperature of aging treatment. In short, the precipitation of the Cu-rich phase was not more than 0.2 vol. % in the test piece K3 aged at 400° C. or the test piece K4 aged at 900° C., and any of these test pieces showed poor anti-microbial property. The test pieces K17 and K18 aged in the temperature range defined by this invention showed poor anti-microbial property, too, since the Cu content was insufficient in these steel.

Example 2

Austenitic stainless steels each having the composition shown in Table 3 were melted in a 30 kg-vacuum melting furnace, forged, hot rolled, annealed and then aged. The hot-rolled annealed sheets obtained in this way were repeatedly subjected to cold-rolling and annealing, so as to finally produce annealed cold-rolled sheets of 0.7 mm in thickness. The steel sheets which had not been aged after hot-rolling were aged after final annealing. The aging treatment after hot-rolling or final annealing was continuted 100 hrs.

Test pieces obtained from those sheets were observed under a transmission electron microscope to quantitatively measure the precipitation of the Cu-rich phase. The anti-microbial property of each steel was also tested and evaluated in the same way as in Example 1.

Each evaluation result together with the precipitation of the Cu-rich phase is shown in Table 3. It is noted that any of the test pieces No. 1–13 containing 1.0 wt. % or more Cu and having the Cu-rich phase precipitated at the ratio of 0.2 vol. % or more exhibited excellent anti-microbial property.

On the other hand, the test piece No. 18 which was not subjected to the aging treatment, although containing 1.0 wt. % or more Cu, had the Cu-rich phase precipitated at the ratio less than 0.2 vol. % and exhibited poor anti-microbial property. The precipitation of the Cu-rich phase was reduced below 0.2 vol. %, when the steel was aged at a temperature lower than 500° C. or higher than 900° C., as noted in the test pieces Nos. 15–17. These results show that Cu content in amount of 1.0 wt. % or more and the precipitation of the Cu-rich phase at the ratio of 0.2 vol. % or more are necessary for the improvement of the anti-microbial property, and that the aging treatment at 500°–900° C. is necessary to increase the precipitation of the Cu-rich phase at the ratio of 0.2 vol. % or more.

TABLE 3

THE EFFECT OF COMPOSITION OF AUSTENITIC STAINLESS STEEL AND CONDITIONS OF HEAT TREATMENT ON PRECIPITATION OF Cu-RICH PHASE AND ANTI-MICROBIAL PROPERTY

| NOTE | TEST No. | ALLOYING ELEMENT (wt. %) | | | | | | | | AGING TREATMENT | | PRECIPITATION OF Cu-RICH PHASE (vol. %) | ANTI-MICROBIAL PROPERTY |
|---|---|---|---|---|---|---|---|---|---|---|---|---|---|
| | | C | Si | Mn | Ni | Cr | N | Cu | OTHERS | PERIOD | Temp. (°C.) | | |
| PRESENT INVENTION | 1 | 0.06 | 0.48 | 1.50 | 8.2 | 18.2 | 0.01 | 1.05 | — | after final annealing | 700 | 0.21 | ○ |
| | 2 | 0.02 | 1.50 | 1.98 | 7.8 | 16.0 | 0.02 | 1.93 | — | after final annealing | 700 | 0.23 | ○ |
| | 3 | 0.04 | 0.59 | 1.73 | 9.4 | 18.2 | 0.02 | 3.07 | — | after hot rolling | 800 | 0.42 | ◎ |
| | 4 | 0.01 | 0.11 | 0.77 | 11.8 | 16.9 | 0.01 | 3.99 | — | after final annealing | 900 | 1.78 | ◎ |
| | 5 | 0.01 | 0.20 | 1.10 | 20.0 | 25.8 | 0.01 | 4.88 | — | no | — | 1.23 | ◎ |

TABLE 3-continued

THE EFFECT OF COMPOSITION OF AUSTENITIC STAINLESS STEEL AND CONDITIONS OF HEAT TREATMENT ON PRECIPITATION OF Cu-RICH PHASE AND ANTI-MICROBIAL PROPERTY

| NOTE | TEST No. | ALLOYING ELEMENT (wt. %) C | Si | Mn | Ni | Cr | N | Cu | OTHERS | AGING TREATMENT PERIOD | Temp. (°C.) | PRECIPITATION OF Cu-RICH PHASE (vol. %) | ANTI-MICROBIAL PROPERTY |
|---|---|---|---|---|---|---|---|---|---|---|---|---|---|
| | 6 | 0.06 | 0.42 | 1.47 | 8.2 | 18.2 | 0.02 | 2.99 | Nb: 0.66 | after hot rolling | 750 | 0.77 | ◎ |
| | 7 | 0.05 | 0.50 | 1.50 | 8.2 | 18.2 | 0.03 | 2.98 | Ti: 0.52 | after final annealing | 700 | 0.82 | ◎ |
| | 8 | 0.04 | 0.22 | 4.51 | 7.0 | 13.5 | 0.01 | 2.50 | Mo: 2.50 | after final annealing | 800 | 0.67 | ○ |
| | 9 | 0.02 | 0.20 | 0.21 | 8.3 | 18.2 | 0.01 | 2.50 | Al: 0.88 | after final annealing | 700 | 0.56 | ○ |
| | 10 | 0.04 | 0.50 | 1.25 | 8.2 | 18.3 | 0.02 | 2.99 | Zr: 0.91 | after hot rolling | 700 | 0.88 | ◎ |
| | 11 | 0.04 | 0.44 | 1.51 | 8.2 | 18.2 | 0.01 | 3.69 | V: 0.89 | after hot rolling | 700 | 0.91 | ◎ |
| | 12 | 0.01 | 0.51 | 4.20 | 7.9 | 19.0 | 0.01 | 2.50 | B: 0.01 | after final annealing | 550 | 0.44 | ○ |
| | 13 | 0.02 | 0.50 | 1.02 | 8.0 | 18.2 | 0.01 | 3.22 | REM: 0.01 | after hot rolling | 600 | 0.39 | ◎ |
| COM- | 14 | 0.05 | 0.45 | 1.01 | 8.2 | 18.2 | 0.02 | 0.50 | — | after final annealing | 800 | 0.01 | X |
| PARA- | 15 | 0.02 | 1.50 | 1.98 | 7.8 | 16.0 | 0.02 | 1.93 | — | after final annealing | 950 | 0.01 | X |
| TIVE | 16 | 0.04 | 0.53 | 1.73 | 9.4 | 18.2 | 0.02 | 3.07 | — | after hot rolling | 950 | 0.04 | X |
| EX- | 17 | 0.04 | 0.53 | 1.73 | 9.4 | 18.2 | 0.02 | 3.07 | — | after hot rolling | 400 | 0.12 | Δ |
| AMPLES | 18 | 0.01 | 0.11 | 0.77 | 11.8 | 16.9 | 0.01 | 3.99 | — | no | — | 0.05 | X |

Example 3

Martensitic stainless steels each having the composition shown in Table 4 were melted in a 30 kg-vacuum melting furnace, forged, and then hot rolled. The hot-rolled sheets obtained in this way were annealed at 500°–900° C., while changing heating times variously in the range of 1 hour or longer. Thereafter, the annealed sheets were cold rolled to 1.5 mm in thickness and continuously annealed at 700°–900° C. within the time of 10 minutes or shorter as final annealing. In Table 4, the group A represents stainless steels containing 0.4 wt. % or more Cu according to the present invention, while the group B represents stainless steels containing Cu less than 0.4 wt. %.

TABLE 4

COMPOSITIONS OF MARTENSITIC STAINLESS STEELS USED IN EXAMPLE 3

| NOTE | STEEL KIND | ALLOYNG COMPONENTS (wt. %) C | Si | Mn | Ni | Cr | N | Cu | Mo | V |
|---|---|---|---|---|---|---|---|---|---|---|
| PRESENT | A 1 | 0.31 | 0.55 | 0.55 | 0.10 | 12.8 | 0.03 | 0.55 | — | — |
| INVENTION | A 2 | 0.33 | 1.54 | 0.54 | 0.10 | 13.0 | 0.03 | 1.54 | — | — |
| | A 3 | 0.40 | 0.51 | 0.60 | 0.11 | 12.9 | 0.03 | 3.00 | — | — |
| | A 4 | 0.35 | 0.55 | 0.55 | 0.10 | 13.1 | 0.02 | 4.42 | — | — |
| | A 5 | 0.02 | 0.50 | 0.60 | 0.10 | 11.8 | 0.02 | 0.81 | — | — |
| | A 6 | 0.02 | 0.51 | 0.75 | 0.11 | 12.0 | 0.02 | 2.05 | — | — |
| | A 7 | 0.02 | 2.55 | 0.51 | 0.11 | 11.9 | 0.01 | 3.55 | — | — |
| | A 8 | 0.01 | 0.33 | 0.61 | 0.11 | 12.1 | 0.01 | 2.77 | 3.25 | — |
| | A 9 | 0.02 | 0.52 | 0.53 | 0.10 | 12.2 | 0.02 | 3.01 | — | 0.61 |
| | A10 | 0.40 | 0.54 | 0.64 | 0.09 | 13.1 | 0.02 | 2.50 | 2.55 | — |
| | A11 | 0.31 | 0.49 | 0.52 | 0.10 | 13.0 | 0.03 | 2.51 | — | 0.78 |
| COMPARATIVE | B 1 | 0.30 | 0.54 | 0.51 | 0.11 | 13.2 | 0.02 | 0.31 | — | — |
| EXAMPLES | B 2 | 0.41 | 0.49 | 0.56 | 0.10 | 13.0 | 0.03 | 0.25 | 1.35 | — |
| | B 3 | 0.35 | 0.51 | 0.50 | 0.09 | 13.1 | 0.03 | 0.27 | — | 0.55 |
| | B 4 | 0.02 | 0.49 | 0.55 | 0.10 | 11.9 | 0.01 | 0.34 | — | — |
| | B 5 | 0.01 | 0.51 | 0.50 | 0.11 | 12.0 | 0.01 | 0.30 | 0.47 | — |
| | B 6 | 0.01 | 0.41 | 0.52 | 0.08 | 11.8 | 0.01 | 0.25 | — | 0.45 |

A test piece obtained from each steel sheet was observed under a transmission electron microscope to quantitatively measure the precipitation of Cu-rich phase. The anti-microbial property of each test piece was examined and evaluated in the same manner as in Example 1.

The evaluation results together with the precipitation of the Cu-rich phase are shown in Table 5. It is noted that all of the test piece Nos. 1–11 (Group A) exhibited an excellent anti-microbial property, since the steels contained 0.4 wt. % or more Cu with the precipitation of Cu-rich phase at the ratio of 0.2 vol. % or more.

On the other hand, the steels of the Group-B having lower Cu content showed a poor anti-microbial property, since the precipitation ratio of the Cu-rich phase was less than 0.2 vol. % even when the hot-rolled steel sheets were annealed at 500°–900° C. When the annealing temperature was lower than 500° C. or higher than 900° C., the Cu-rich phase was precipitated at the ratio less than 0.2 vol. % resulting in poor anti-microbial property, which demonstrates the criticality of the 0.2 vol. % value.

TABLE 5

THE EFFECT OF ANNEALING TEMPERATURE FOR HOT ROLLED SHEET ON THE PRECIPITATION OF Cu-RICH PHASE AND ANTI-MICROBIAL PROPERTY

| PRESENT INVENTION | | | | COMPARATIVE EXAMPLES | | | |
|---|---|---|---|---|---|---|---|
| STEEL KIND | ANNEAL TEMP. (°C.) | Cu-RICH PHASE (vol. %) | ANTI-MICROBIAL PROPERTY | STEEL KIND | ANNEAL TEMP. (°C.) | Cu-RICH PHASE (vol. %) | ANTI-MICROBIAL PROPERTY |
| A 1 | 650 | 0.25 | ○ | B 1 | 850 | 0.01 | X |
| A 2 | 750 | 0.46 | ◎ | B 2 | 800 | 0.01 | X |
| A 3 | 800 | 0.78 | ◎ | B 3 | 850 | 0.07 | Δ |
| A 4 | 850 | 2.02 | ◎ | B 4 | 800 | 0.05 | Δ |
| A 5 | 850 | 0.31 | ○ | B 5 | 850 | 0.08 | Δ |
| A 6 | 800 | 0.45 | ◎ | B 6 | 800 | 0.07 | Δ |
| A 7 | 750 | 0.65 | ◎ | A 4 | 950 | 0.12 | Δ |
| A 8 | 700 | 1.32 | ◎ | A 4 | 450 | 0.05 | X |
| A 9 | 550 | 0.42 | ◎ | A 7 | 950 | 0.08 | Δ |
| A10 | 750 | 0.73 | ◎ | A 7 | 480 | 0.02 | X |
| A11 | 800 | 0.81 | ◎ | A 8 | 950 | 0.07 | Δ |
| | | | | A10 | 480 | 0.03 | X |

Table 6 shows the relationship between the ratio of the Cu-rich phase precipitated in a steel sheet finally annealed according to the present invention and the evaluation of the anti-microbial property. It is noted that the Cu-rich phase remained effectively in the durability of anti-microbial property, when the steel sheet containing 0.4 wt. % or more Cu was finally annealed at 700°–900° C. after being subjected in a hot rolled state to annealing at 500°–900° C.

On the other hand, even in the case where a hot rolled sheet had been annealed at 500°–900° C., the precipitation of the Cu-rich phase in the steel sheet containing Cu in amount less than 0.4 wt. % (B1-6 in Table 7) which was continuously annealed at 700°–900° C. was less than 0.2 vol. % resulting in poor anti-microbial property, since the Cu content in the steel was low. In the case of the steel sheets containing enough Cu (A4, 7 and 8 in Table 7) where the temperature for annealing the hot rolled sheet was lower than 500° C. or higher than 900° C., the precipitation of the Cu-rich phase in the steel sheet finally annealed at 700°–900° C. did not reach 0.2 vol. % resulting in a poor anti-microbial property, since the final annealing was continuous and short in time.

A test piece obtained by annealing a hot rolled steel sheet A4 6 hrs. at 750° C., cold rolling it and then annealing it 1 minute at 750° C. was observed by SEM-EDX. The test piece had a metallurgical structure in which the Cu-rich phase precipitates were uniformly and minutely dispersed in the matrix. The stainless steel having said structure was excellent in anti-microbial property.

TABLE 6

THE EVALUATION OF ANTI-MICROBIAL PROPERTY OF ANNEALED COLD-ROLLED MARTENSITIC STAINLESS STEEL (THE PRESENT INVENTION)

| STEEL KIND | ANNEALING TEMP. FOR HOT ROLLED SHEET (°C.) | ANNEALING TEMP. FOR COLD ROLLED SHEET (°C.) | Cu-RICH PHASE (vol. %) | ANTI-MICROBIAL PROPERTY |
|---|---|---|---|---|
| A1 | 650 | 900 | 0.22 | ○ |
| A2 | 750 | 900 | 0.36 | ◎ |
| A3 | 800 | 850 | 0.65 | ◎ |
| A4 | 850 | 850 | 2.02 | ◎ |
| A5 | 850 | 800 | 0.31 | ○ |

TABLE 6-continued

THE EVALUATION OF ANTI-MICROBIAL PROPERTY OF ANNEALED COLD-ROLLED MARTENSITIC STAINLESS STEEL (THE PRESENT INVENTION)

| STEEL KIND | ANNEALING TEMP. FOR HOT ROLLED SHEET (°C.) | ANNEALING TEMP. FOR COLD ROLLED SHEET (°C.) | Cu-RICH PHASE (vol. %) | ANTI-MICROBIAL PROPERTY |
|---|---|---|---|---|
| A6 | 800 | 800 | 0.45 | ◎ |
| A7 | 750 | 900 | 0.65 | ◎ |
| A8 | 700 | 900 | 1.32 | ◎ |
| A9 | 550 | 850 | 0.42 | ◎ |
| A10 | 750 | 800 | 0.73 | ◎ |
| A11 | 800 | 800 | 0.81 | ◎ |

TABLE 7

THE EVALUATION OF ANTI-MICROBIAL PROPERTY OF ANNEALED COLD-ROLLED MARTENSITIC STAINLESS STEEL (COMPARATIVE EXAMPLES)

| STEEL KIND | ANNEALING TEMP. FOR HOT ROLLED SHEET (°C.) | ANNEALING TEMP. FOR COLD ROLLED SHEET (°C.) | Cu-RICH PHASE (vol. %) | ANTI-MICROBIAL PROPERTY |
|---|---|---|---|---|
| B1 | 850 | 850 | 0.02 | x |
| B2 | 800 | 850 | 0.01 | x |
| B3 | 850 | 800 | 0.05 | Δ |
| B4 | 800 | 800 | 0.02 | x |
| B5 | 850 | 750 | 0.07 | Δ |
| B6 | 800 | 750 | 0.08 | Δ |
| A4 | 950 | 750 | 0.07 | Δ |
| A4 | 450 | 850 | 0.04 | x |
| A7 | 950 | 900 | 0.05 | x |
| A7 | 450 | 850 | 0.02 | x |
| A8 | 950 | 800 | 0.04 | x |
| A10 | 480 | 800 | 0.03 | x |

According to the present invention as aforementioned, the anti-microbial property of stainless steel itself is greatly improved by controlling Cu content in the steel material and by controlling the precipitation ratio of the Cu-rich phase in the matrix. Since the anti-microbial function is derived from the underlying material itself, and not a coating, the stainless steel keeps its excellent anti-microbial function for a long time. Consequently, the stainless steel is useful as material in various fields requiring sanitary environments, e.g. kitchen goods, devices or tools useful at a hospital, interior parts for building and grips or poles for tansportation vehicles such as buses or electric cars with which many and unspecified persons come into contact.

What is claimed is:

1. A method of using a stainless steel containing 0.4–5.0 wt. % Cu and having a structure including a secondary phase predominantly composed of Cu precipitated at a ratio of at least 0.2 vol. % in the matrix to provide an anti-microbial surface for various devices or tools.

2. The method of claim 1 wherein the stainless steel is heated at a temperature of 500°–900° C. for a time sufficient to precipitate the secondary phase predominantly composed of Cu at a ratio of at least 0.2 vol. % in the matrix.

3. The method of claim 1 wherein the various devices or tools include kitchen goods, hospital goods, architectural goods and grips or polls for public transportation means.

4. A method of using a ferritic stainless steel containing at least 0.1 wt. % C, at least 2 wt. % Mn, 10–30 wt. % Cr, 0.4–3 wt. % Cu and the balance essentially Fe, including a secondary phase predominantly composed of Cu precipitated at a ratio of at least 0.2 vol. % in the matrix to provide an anti-microbial surface for various devices and tools.

5. The method of claim 4 wherein the ferritic stainless steel further contains 0.02–1 wt. % of at least one member selected from the group consisting of Nb and/or Ti.

6. The method of claim 4 wherein the ferritic stainless steel further contains at least one member selected from the group consisting of 3 wt. % Mo, 1 wt. % Al, 1 wt. % Zr, 1 wt. % V, 0.05 wt. % B and 0.05 wt. % rare earth metals.

7. The method of claim 4 wherein the various devices or tools include kitchen goods, hospital goods, architectural goods and grips or polls for public transportation means.

8. A method of using a ferritic stainless steel containing 0.1 wt. % or less C, 2 wt. % or less Si, 2 wt. % or less Mn, 10–30 wt. % Cr, 0.4–3 wt. % Cu, optionally one or more selected from the group of 0.02–1 wt. % Nb and/or Ti, up to 3 wt. % Mo, up to 1 wt. % Al, up to 1 wt. % Zr, up to 1 wt. % V, up to 0.05 wt. % B and up to 0.05 wt. % rare earth metals and the balance being essentially Fe, wherein the ferritic stainless steel is cold rolled, annealed and aged at 500°–°800° C. so as to precipitate a secondary phase predominantly composed of Cu at a ratio of at least 0.2 vol. % in the matrix to provide an anti-microbial surface for various devices or tools.

9. The method of claim 8 wherein the various devices or tools include kitchen goods, hospital goods, architectural goods and grips or polls for public transportation means.

10. A method of using an austenitic stainless steel containing 0.1 wt. % or less C, 2 wt. % or less Si, 5 wt. % or less Mn, 10–30 wt. % Cr, 5–15 wt. % Ni, 1.0–5.0 wt. % Cu and the balance being essentially Fe, including a secondary phase predominantly composed of Cu precipitated at a ratio of at least 0.2 vol. % in the matrix to provide an anti-microbial surface for various devices or tools.

11. The method of claim 10 wherein the austenitic stainless steel further contains one or more of 0.02–1 wt. % Nb and Ti, up to 3 wt. % Mo, up to 1 wt. % Al, up to 1 wt. % Zr, up to 1 wt. % V, up to 0.05 wt. % B and up to 0.05 wt. % rare earth metals (REM).

12. The method of claim 10 wherein the various devices or tools include kitchen goods, hospital goods, architectural goods and grips or polls for public transportation means.

13. A method of using an austenitic stainless steel containing 0.1 wt. % or less C, 2 wt. % or less Si, 5 wt. % or less Mn, 10–30 wt. % Cr, 5–15 wt. % Ni, 1.0–5.0 wt. % Cu, optionally one or more of 0.02–1 wt. % Nb and/or Ti, up to 3 wt. % Mo, up to 1 wt. % Al, up to 1 wt. % Zr, up to 1 wt. % V, up to 0.05 wt. % B and up to 0.05 wt. % rare earth metals and the balance being essentially Fe, wherein the austenitic stainless steel is hot rolled to form a steel sheet and heat treated at least one time at a temperature in the range of 500°–900° C. to precipitate a secondary phase predominantly composed of Cu at a ratio of at least 0.2 vol. % in the matrix to provide an anti-microbial surface for various devices or tools.

14. The method of claim 13 wherein the various devices or tools include kitchen goods, hospital goods, architectural goods and grips or polls for public transportation means.

15. A method of using a martensitic stainless steel consisting essentially of up to 0.8 wt. % C, up to 3 wt. % Si, 10–20 wt. % Cr, 0.4–5.0 wt. % Cu and the balance being essentially Fe, and wherein a secondary phase predominantly composed of Cu is precipitated at a ratio of at least 0.2 vol. % in the matrix to provide an anti-microbial surface for various devices or tools.

16. The method of claim 15 wherein the martensitic stainless steel further contains at least one of up to 4 wt. % Mo and up to 1 wt. % V.

17. The method of claim 16 wherein the various devices or tools include kitchen goods, hospital goods, architectural goods and grips or polls for public transportation means.

18. A method of using a martensitic stainless steel containing up to 0.8 wt. % C, up to 3 wt. % Si, 10–20 wt. % Cr, 0.4–5.0 wt. % Cu, and optionally at least one of up to 4 wt. % Mo and up to 1 wt. % V, and the balance being essentially Fe, wherein the martensitic steel is hot rolled to form a hot-rolled steel sheet, annealed and batch-type annealed at 500°–900° C. for at least one hour so as to precipitate a secondary phase predominantly composed of Cu at a ratio of at least 0.2 vol. % in the matrix to provide an anti-microbial surface for various devices or tools.

19. The method of claim 18 wherein the batch-type annealed steel sheet is cold rolled and then continuously annealed at a temperature of 700°–900° C.

20. The method of claim 18 wherein the various devices or tools include kitchen goods, hospital goods, architectural goods and grips or polls for public transportation means.

* * * * *

UNITED STATES PATENT AND TRADEMARK OFFICE

CERTIFICATE OF CORRECTION

PATENT NO. : 5,861,068

DATED : January 19, 1999

INVENTOR(S) : Morihiro Hasegawa et al.

It is certified that error appears in the above-identified patent and that said Letters Patent is hereby corrected as shown below:

Title Page, [57] ABSTRACT, line 7, after "900°" insert --C--.

Column 1 Line 12 "the present, time" should read --the present time,--.

Column 1 Line 36 before "relatively" insert --a--.

Column 2 Line 4 after "such" delete --the--.

Column 2 Line 16 after "such" delete --the--.

Column 3 Line 66 after "improving" insert --corrosion--.

Column 4 Line 19 "in amount" should read --in an amount--.

Column 4 Line 46 "in amount" should read --in an amount--.

Column 4 Line 55 "in amount" should read --in an amount--.

Column 4 Line 62 after "controlled" insert --at--.

Column 5 Line 4 "are no restriction" should read --are no restrictions--.

Column 5 Line 6 after "both" delete --of--.

Column 5 Line 32 "otional" should read --optional--.

Column 5 Line 42 after "carbonitrides," delete --as--.

Column 6 Line 15 "in amount" should read --in an amount--.

UNITED STATES PATENT AND TRADEMARK OFFICE

CERTIFICATE OF CORRECTION

PATENT NO. : 5,861,068

DATED : January 19, 1999

INVENTOR(S) : Morihiro Hasegawa et al.

It is certified that error appears in the above-identified patent and that said Letters Patent is hereby corrected as shown below:

Column 6 Line 20 "in amount" should read --in an amount--.

Column 6 Line 34 "in amount" should read --in an amount--.

Column 6 Line 40 after "both" delete --of--.

Column 6 Line 55 "cabide" should read --carbide--.

Column 7 Line 5 "a too low" should read --at too low--

Column 7 Line 31 "were further" should read --was further--.

Column 8 Line 20 "petridish" should read --petri dish--.

Column 9 Line 30 after "approximately" insert --the--.

Column 9 Line 34 "in amount" should read --in an amount--.

Column 9 Line 44 "these steel" should read --these steels--.

Column 10 Line 25 "continuted" should read --continued--.

Column 10 Line 45 "in amount" should read --in an amount--.

Column 11 Table 4, heading "ALLOYNG" should read --ALLOYING--.

Column 13 Lines 33-34 "in amount" should read --in an amount--.

Column 15 Line 3 "tansportation" should read --transportation--.

Column 15 Line 18 Claim 3 "polls" should read --poles--.

UNITED STATES PATENT AND TRADEMARK OFFICE

CERTIFICATE OF CORRECTION

PATENT NO. : 5,861,068

DATED : January 19, 1999

INVENTOR(S) : Morihiro Hasegawa et al.

It is certified that error appears in the above-identified patent and that said Letters Patent is hereby corrected as shown below:

Column 15 Line 34 Claim 7 "polls" should read --poles--.

Column 15 Line 43 Claim 8 "500°-°800°C" should read --500°-800°C--.

Column 15 Line 49 Claim 9 "polls" should read --poles--.

Column 16 Line 8 Claim 12 "polls" should read --poles--.

Column 16 Line 25 Claim 14 "polls" should read --poles--.

Column 16 Line 36 Claim 17 "of claim 16" should read --of claim 15--.

Column 16 Line 38 Claim 17 "polls" should read --poles--.

Column 16 Line 54 Claim 20 "polls" should read --poles--.

Signed and Sealed this

Thirteenth Day of July, 1999

*Attest:*

Q. TODD DICKINSON

*Attesting Officer*

*Acting Commissioner of Patents and Trademarks*